United States Patent [19]

Remley

[11] 4,153,744

[45] May 8, 1979

[54] PROCESS FOR IMPARTING FLAME RESISTANCE AND RESISTANCE TO ULTRAVIOLET LIGHT-INDUCED SHADE CHANGE TO VAT-DYED CELLULOSIC TEXTILE MATERIALS

[75] Inventor: Kenneth H. Remley, Warren, N.J.

[73] Assignee: American Cyanamid Company, Stamford, Conn.

[21] Appl. No.: 849,283

[22] Filed: Nov. 7, 1977

[51] Int. Cl.[2] ..... B05D 1/38; B05D 3/10

[52] U.S. Cl. ..... 427/160; 427/341; 427/342

[58] Field of Search ..... 427/160, 341, 342

[56] References Cited

U.S. PATENT DOCUMENTS

| | | | |
|---|---|---|---|
| 2,983,623 | 5/1961 | Coates | 427/342 X |
| 3,096,201 | 7/1963 | Coates et al. | 427/341 |
| 3,236,676 | 2/1966 | Coates et al. | 427/341 X |
| 3,936,585 | 2/1976 | Leblanc et al. | 427/342 X |

*Primary Examiner*—James R. Hoffman

*Attorney, Agent, or Firm*—H. G. Jackson

[57] ABSTRACT

The invention is a process for imparting resistance to ultraviolet light-induced shade change to vat-dyed cellulose flame resistant material by contacting the material, after a flame retardant treatment with a phosphorus flame retardant and ammonia, with an oxidizing solution of hydrogen peroxide, acetic acid and water.

8 Claims, No Drawings

PROCESS FOR IMPARTING FLAME RESISTANCE AND RESISTANCE TO ULTRAVIOLET LIGHT-INDUCED SHADE CHANGE TO VAT-DYED CELLULOSIC TEXTILE MATERIALS

This invention relates to a process for minimizing shade change on vat-dyed cellulosic textile materials treated with fire-retarding chemicals and ammonia. More particularly, the invention relates to a process for minimizing ultraviolet light-induced shade change on ammonia-cured vat-dyed cotton and cotton/polyester fabrics treated with a tetrakis(hydroxymethyl)phosphonium salt, a mixture of said salts, or a partially polymerized methylol phosphorus material containing at least one free methylol group attached to a phosphorus atom.

The ammonia-curing of tetrakis(hydroxymethyl)-phosphonium salts and partially polymerized methylol phosphorus materials on cellulosic textile materials is disclosed by Coates in U.S. Pat. Nos. 3,236,676 and 2,983,623, respectively.

The ammonia-curing of various tetrakis(hydroxymethyl)phosphonium salts, or mixtures of said salts, on cellulosic textile materials under various conditions, is described in commonly assigned pending U.S. patent applications Ser. Nos. 517,706, 517,707 and 597,727.

The ammonia-curing of condensation products of tetrakis(hydroxymethyl)phosphonium sulfate and urea on partially dried cellulosic textile materials is disclosed in commonly assigned pending U.S. patent application Ser. No. 665,014.

When vat-dyed cellulosic textile materials are treated by the processes described in the above-mentioned references to obtain satisfactory fire retardance and then exposed to sunlight, or a carbon arc in a Fade-Ometer® for about 20 hours, they exhibit a definite shade change when compared with the unexposed dyed fabric. After the exposed fabric stands in a dark room for 8–24 hours, depending on atmospheric conditions, the shade returns to normal. Thus, it appears that a photo-induced reduction of the dye to the acid leuco form is slowly reversed by an oxidation process in the presence of moisture.

A study of the fading of the treated fabric in a Fade-Ometer®, Atlas Electric Devices Company, Chicago, Illinois, using various filters to cut off the irradiation at specific wavelengths, showed that the change in shade is caused by ultraviolet light.

By treating the dyed fabric with a solution of a tetrakis(hydroxymethyl)phosphonium salt, without ammoniation, and drying, a fabric is obtained which does not change shade when exposed in the Fade-Ometer® for 20 hours. This result led to the conclusion that the dye shade change is caused by the nitrogen atoms in the resulting polymer. This could occur if a tertiary nitrogen atom loses an electron, when excited by ultraviolet light, thus reducing the dye to the acid leuco form. After exposure the acid leuco form of the dye is gradually oxidized back to the original vat dye thus eliminating the shade change caused by the presence of the acid leuco form.

Based on the above information an effort was made to oxidize the tertiary nitrogen atom to the N-oxide and eliminate the photo-induced reduction to the acid leuco form.

In U.S. Pat. No. 3,236,676 Coates et al. teach the oxidation of an ammonia-cured tetrakis(hydroxymethyl)phosphonium salt with 20% aqueous hydrogen peroxide at ambient temperature followed by washing and drying (see column 4, lines 7–8 and Example 2). However, when this process was carried out using a vat-dyed textile material and the treated fabric was exposed to ultraviolet light for 20 hours, the shade change was quite noticeable.

SUMMARY OF THE INVENTION

A process is provided for minimizing ultraviolet light-induced shade change on a vat-dyed cellulosic textile material which comprises impregnating said cellulosic textile material with an aqueous solution of a tetrakis(hydroxymethyl)phosphonium salt, a mixture of said tetrakis(hydroxymethyl)phosphonium salts, or a partially polymerized methylol phosphorus material to deposit thereon about 3–7% phosphorus based on the weight of the untreated textile material, partially drying the impregnated textile material, contacting the partially dried textile material with gaseous ammonia to deposit therein a substantially water-insoluble phosphorus-containing polymer, contacting the ammoniated textile material with an aqueous mixture of hydrogen peroxide and acetic acid containing about 18–25% hydrogen peroxide, about 30–50% acetic acid and about 50–25% water, at an elevated temperature for a suitable oxidizing period, rinsing with water and drying.

Preferably, the oxidized vat-dyed cellulosic textile material is contacted with an aqueous solution of an alkalizing agent at about 55°–65° C. for about 15 minutes, then rinsed with water and dried.

In an especially preferred embodiment, a vat-dyed cellulosic textile material is impregnated with a neutralized aqueous solution of tetrakis(hydroxymethyl)phosphonium sulfate to deposit thereon about 4–5% phosphorus based on the weight of the untreated material, partially dried, contacted with gaseous ammonia, immersed in an aqueous mixture of about 22% hydrogen peroxide, 38% acetic acid, and 40% water at about 60°–65° C. for a period of about 15 minutes, contacted with an aqueous solution of caustic soda having a pH of about 9–9.5, rinsed with water and dried.

The process of this invention differs from the processes of the prior art in that (1) the treated fabric is vat-dyed, and (2) the oxidizing solution contains acetic acid.

DESCRIPTION OF PREFERRED EMBODIMENTS

The term "cellulosic textile material," as used herein, is defined as a material containing at least 20% cellulosic fibers.

Vat dyes which exhibit ultraviolet light-induced shade change on cellulosic textile materials containing ammonia-cured flame retardant materials include such as: Vat Blue 1, 6, 14, 18; Vat Yellow 1; Vat Violet 2; Vat Black 22, 27; Vat Orange 9; Vat Red 1; Vat Green 1; and Vat Brown 1. Other vat dyes having the shade change problem may also be used.

In carrying out this invention an aqueous solution of a tetrakis(hydroxymethyl)phosphonium salt, a mixture of tetrakis(hydroxymethyl)phosphonium salts, or, a polymerizable methylol phosphorus polymeric material having at least one free methylol group attached to a phosphorus atom is prepared. The pH of the solution may range from about 3 to 8. Preferably, the pH is about 7.4 to 7.6.

Suitable salts which may be used singly, or in combinations, include tetrakis(hydroxymethyl)phosphonium acetate, chloride, phosphate, sulfate, glycolate, citrate, oxalate, lactate, malate, and the like.

The preferred single salt is tetrakis(hydroxymethyl)-phosphonium sulfate.

The preferred mixture of salts consists of about 60 mole percent tetrakis(hydroxymethyl)phosphonium acetate and 40 mole percent tetrakis(hydroxymethyl)-phosphonium phosphate.

Suitable polymerizable methylol phosphorus polymeric materials which may be used include the condensation products of urea and the aforementioned tetrakis(hydroxymethyl)phosphonium salts.

The preferred polymeric material is a condensation product of urea and tetrakis(hydroxymethyl)phosphonium sulfate.

Generally, about 0.1–2.0% real of a surfactant is also included in the application solution. The surfactant may be cationic, anionic, or nonionic. Preferably, the surfactant is nonionic. Illustrative examples of suitable surfactants include the following:

nonylphenol-ethylene oxide polyether alcohols,
trimethylnonyl polyethylene glycol ether,
octylphenoxy polyethoxy ethanol,
isooctylphenoxy polyethoxy ethanol,
dihexyl ester of sodium sulfosuccinic acid.

The preferred surfactant is trimethylnonyl polyethylene glycol ether.

Optionally, an acid-binding agent may also be included in the application solution.

Illustrative examples of suitable acid-binding agents include sodium acetate, ammonium acetate, sodium carbonate, sodium bicarbonate, potassium hydroxide, and the like. The preferred acid-binding agent is sodium acetate.

The general application procedure involves impregnating a vat-dyed cellulosic textile material, preferably 100% cotton or cotton/polyester, with the application solution to deposit therein about 3–7%, preferably about 4–5%, by weight of phosphorus, based on the weight of the untreated textile material. The percentage of phosphorus applied may be readily calculated from the percent by weight of phosphorus in the application solution and the percent by weight wet pickup of the impregnated textile material, based on the weight of the untreated material.

Any suitable method may be used for impregnating the textile material with the application solution. Padding, spraying, and dipping, with or without the use of vacuum impregnation, are suitable methods. The excess application solution may be removed, if necessary, by squeezing, centrifuging, and the like.

The treated textile material is then partially dried to a water content between 5 and 20%, preferably between 10 and 15%. After partially drying, the treated sample is weighed and immediately sealed in a polyethylene bag in order to retain the moisture before ammoniation.

The drying temperature of the treated fabric can be varied depending on the drying time and the weight or bulk of the material. The temperature and drying time are adjusted to produce the desired residual water content. However, the drying process is not carried to the point where any fixation of the material is effected.

The drying time may range from 20 seconds to 3 minutes at 107° C.; preferably, it ranges from 30 seconds to 2 minutes at 107° C.

The partially dried textile material is exposed to a high concentration of gaseous ammonia to form an insoluble flame retardant polymer within the material. This can be done by any method that permits contact of the material with ammonia. Thus, the material can be contacted with ammonia by simply placing the material in an enclosed chamber through which ammonia is circulated for the time required for the desired curing process.

However, in commercial operations, it is preferable to pass the material (as from rolls) continuously through a chamber in which an appropriate ammonia concentration is maintained. The gas temperature is normally room temperature, but may be higher or lower. The curing, i.e., exposure to ammonia, is carried out for a sufficient length of time to effect substantially complete polymerization and curing of the impregnating composition. Typical times for curing are normally within the range of 20 seconds to 3.0 minutes depending on the rate of passage through the chamber and the amount or concentration of the ammonia maintained or passed through the chamber.

The exposure time and the flow rate of ammonia are controlled in such a manner to provide about 2–6, preferably about 4–5, gram-moles of ammonia for every gram-atom of phosphorus being introduced by the treated fabric entering the chamber.

The ammoniated vat-dyed textile material is then subjected to an oxidation by immersion in a concentrated aqueous mixture of hydrogen peroxide and acetic acid at an elevated temperature, generally above about 50° C., preferably about 55°–65° C., most preferably at about 60°–65° C., for a sufficient period to oxidize the material of about 5–25 minutes and recovered. At a temperature of about 60° C. the period need be about 15 minutes; at 70° C., about 10 minutes; at 80° C. about 5 minutes, i.e. the lower the temperature, the longer the oxidizing time. The oxidized material is then rinsed with water and dried by conventional methods. The drying temperature is not critical.

The oxidizing solution contains about 18–25% hydrogen peroxide, about 30–50% acetic acid, and about 50–30% water. Preferably, the solution contains about 20–25% hydrogen peroxide, about 35–45% acetic acid, and about 45–30% water. Optionally, it may also contain about 0.1–0.2% of a surfactant such as sodium lauryl sulfate or Deceresol ® Surfactant P Special (a modified alkylarylsulfonate; American Cyanamid Company).

Preferably, the oxidized material is contacted with an aqueous solution of an alkalizing agent, preferably caustic soda having a pH of about 9–9.5, rinsed in water at about 60° C. and tumble-dried for about 2 minutes at about 107° C.

Suitable alkalizing agents include aqueous solutions of sodium hydroxide, potassium hydroxide, sodium carbonate, sodium bicarbonate, and the like.

In the examples which follow the resistance to shade change is determined by irradiating the treated material with ultraviolet light (carbon arc) in a Fade-Ometer ® for 20–40 hours and visually comparing it to a non-irradiated control sample.

The following examples illustrate the process of this invention. All parts and percentages expressed are by weight unless otherwise noted.

EXAMPLE 1

The following example illustrates the process of this invention. A pad bath, having a pH of 7.6, is prepared containing the following composition:

| | Parts |
|---|---|
| Aqueous solution of tetrakis(hydroxymethyl)-phosphonium sulfate (85%; pH 3.5–4.0) | 43.9 |
| Aqueous caustic soda (25%) | 22.0 |
| 5% Aqueous solution of dihexyl ester of sodium sulfosuccinic acid | 2.0 |
| Additional water | 32.0 |

Vat Blue 18 dyed cotton/polyester (84%/16%) is immersed in the pad bath, described above, and passed between squeeze rolls at 80 psi to obtain about 67% wet pickup and deposit thereon about 3.8% phosphorus, based on the weight of the untreated material. The impregnated fabric is dried at 107° C. for 2½ minutes and passed into an ammoniation chamber wherein the concentration of ammonia present provides about 3 gram-moles of ammonia per gram-atom of phosphorus on the treated fabric. After a residence period of 15 seconds in the ammoniation chamber, the ammoniated fabric is removed and cut into sections measuring 2½ inches by 7 inches, and weighing about 4.7 grams each.

The pieces of fabric are immersed in 400 parts of an oxidation solution (60° C.) having the following composition:

| % | |
|---|---|
| 38.8 | glacial acetic acid |
| 21.7 | hydrogen peroxide |
| 39.5 | water |

After immersion in the oxidation solution for about 15 minutes, the pieces of fabric are removed and immersed in 400 parts of aqueous caustic soda having a pH of 9.5 for about a minute, rinsed with water and dried.

No shade change of the treated fabric is noted immediately after exposure to ultraviolet light (carbon arc) for 20 hours in a Fade-Ometer, and after several washes.

The treated fabric meets the requirements of the Department of Commerce Standard for Flammability of Children's Sleepwear, DOC FF3-71.

EXAMPLE 2

The procedure of Example 1 is followed except that after oxidation the fabric is rinsed with water and dried. After exposure to ultraviolet light for 20 hours, the shade change is slight.

EXAMPLE 3

The procedure of Example 1 is followed except that the oxidizing solution contains 19% hydrogen peroxide, 34% acetic acid and 47% water. After exposure to ultraviolet light for 20 hours, the shade change is very slight.

EXAMPLE 4

For comparison purposes the procedure of Example 1 is followed except that the oxidizing solution contains 16.4% hydrogen peroxide, 29.0% acetic acid and 54.6% water. After exposure to ultraviolet light for 20 hours, the shade change is noticeable. Thus this oxidizing solution is unsatisfactory.

EXAMPLES 5–8

The procedure of Example 1 is followed except that the period of immersion in the oxidizing solution is varied from 2.5–60 minutes. The results obtained are listed in Table I. These results show the criticality of the period of contact at 60° C.

TABLE I

| Example | Period of Contact (mins.) | Shade Change |
|---|---|---|
| 5 | 2.5 | very noticeable |
| 6 | 5 | very noticeable |
| 7 | 10 | noticeable |
| 8 | 15 | slight |

EXAMPLES 9–11

The procedure of Example 1 is followed except that the temperature of the oxidizing solution is varied from 30°–60° C. The results obtained are listed in Table II. These results show the criticality of the temperature of the oxidizing solution.

TABLE II

| Example | Oxidizing Solution (°C.) | Shade Change |
|---|---|---|
| 9 | 30 | very noticeable |
| 10 | 45 | very noticeable |
| 11 | 60 | slight |

EXAMPLE 12

The procedure of Example 1 is followed in every detail except that Vat Blue 18 dyed cotton sheeting is used instead of Vat Blue 18 dyed cotton/polyester (84%/16%). Similar results are obtained.

EXAMPLES 13–21

The procedure of Example 1 is followed substituting (1) a sufficient amount of the tetrakis(hydroxymethyl)-phosphonium salt of Table III for the tetrakis(hydroxymethyl)phosphonium sulfate to deposit about 4.0% phosphorus on the weight of the fabric, and (2) the vat dyed fabric of Table III for the Vat Blue 18 dyed fabric. In all cases the shade change is rated very slight to none.

TABLE III

| | | Cotton/Polyester (84%/16%) Dyed With | |
|---|---|---|---|
| Example | Phosphonium Salt | | |
| 13 | chloride | Vat Blue | 1 |
| 14 | acetate | Vat Violet | 2 |
| 15 | phosphate | Vat Yellow | 1 |
| 16 | glycolate | Vat Yellow | 1 |
| 17 | citrate | Vat Violet | 2 |
| 18 | oxalate | Vat Blue | 1 |
| 19 | lactate | Vat Black | 27 |
| 20 | malate | Vat Blue | 1 |
| 21 | acetate/phosphate* | Vat Blue | 1 |

*60 mole % acetate/40 mole % phosphate

EXAMPLE 22

Preparation of Condensation Products of Tetrakis(Hydroxymethyl)Phosphonium Sulfate and Urea An aqueous solution (632 grams) containing 85% by weight of tetrakis(hydroxymethyl)phosphonium sulfate (537.2 grams; 1.32 moles) is added to a suitable reaction vessel containing 269 grams of water and 99 grams of urea (1.65 moles). The mixture is stirred and heated at 80°-85° C. for ½ hour. The solution is then cooled to room temperature and 20 mls. of 3% aqueous hydrogen peroxide are added thereto to dispel a pinkish color. The final solution contains 62.4% real solids, 8.2% phosphorus as phosphonium phosphorus, and has a pH of 2.1. The weight ratio of tetrakis(hydroxymethyl)-phosphonium sulfate to urea in this solution is 5.4 to 1.

EXAMPLE 23

A pad bath is prepared containing 56.0 grams of the product of Example 22, sodium acetate (4.5 grams), 0.2 gram real of a trimethylnonyl polyethylene glycol ether nonionic surfactant (Tergitol ® Nonionic TMN-6) and 39.3 grams of additional water to make a total weight of 100 grams. Vat Blue 18 dyed cotton sheeting is then immersed in the pad bath and passed between squeeze rolls at 60 psi to obtain a wet pickup of 100° and deposit thereon 4.6% phosphorus, based on the weight of the untreated fabric. The impregnated fabric is then dried at 82° C. to a residual moisture content of 13%, and passed into an ammoniator chamber where it is exposed to gaseous ammonia for 15 seconds. The flow of ammonia to the chamber is sufficient to maintain a ratio of 3 gram-moles of ammonia per gram-atom of phosphorus present in the ammoniator chamber on the fabric.

After treatment with ammonia, the fabric is processed as described in Example 1. After exposure to ultraviolet light for 20 hours, no shade change is noted.

The treated fabric meets the fire retardancy requirements of DOC FF3-71.

EXAMPLE 24

The procedure of Example 23 is followed substituting Vat Blue 18 dyed cotton/polyester (84%/16%) for the Vat Blue 18 dyed cotton sheeting and depositing thereon 4.0% phosphorus, based on the weight of the untreated fabric. Similar results are obtained.

EXAMPLE 25

A condensation product of tetrakis(hydroxymethyl)-phosphonium chloride and urea is prepared following the procedure of Example 1 of British Pat. No. 938,989. Vat Blue 1 dyed cotton/polyester (84%/16%) is treated therewith following the procedure of Example 23, substituting the condensation product of tetrakis(hydroxymethyl)phosphonium chloride and urea for the product of Example 22. Similar results are obtained.

What is claimed is:

1. A process for imparting resistance to ultraviolet light-induced shade change to a vat-dyed cellulosic flame resistant textile material which comprises:

(a) impregnating a cellulosic textile material with an aqueous solution of a tetrakis(hydroxymethyl)-phosphonium salt, a mixture of tetrakis(hydroxymethyl)phosphonium salts, or a partially polymerized methylol phosphorus material to deposit thereon about 3-7% phosphorus based on the weight of the untreated textile material;

(b) partially drying the impregnated textile material;

(c) contacting the partially dried textile material with about 2-6 gram-moles of gaseous ammonia per gram-atom of phosphorus present thereon to deposit therein a substantially water-insoluble phosphorus-containing polymer;

(d) contacting the ammoniated textile material with an oxidizing solution containing about 18-25% hydrogen peroxide, 30-50% acetic acid, and 50-30% water, at a temperature above about 50° C. for a period of from about 5-25 minutes;

(e) rinsing the oxidized textile material with water, and drying.

2. The process of claim 1 wherein the ammoniated textile material is contacted with the oxidizing solution at about 60°-65° C. for a period of about 15 minutes.

3. The process of claim 1 wherein prior to (e) the hydrogen peroxide-acetic acid impregnated material is contacted with an aqueous solution of an alkalizing agent.

4. The process of claim 3 wherein the alkalizing agent is caustic soda having a pH of about 9.0 to 9.5.

5. The process of claim 3 wherein the textile material is impregnated with a tetrakis(hydroxymethyl)phosphonium salt in step (a).

6. The process of claim 3 wherein the cellulosic textile material is cotton or cotton-polyester fabric.

7. The process of claim 1 wherein the tetrakis(hydroxymethyl)phosphonium salt is selected from the sulfate, chloride, acetate, and phosphate salts, and mixtures thereof.

8. The process of claim 1 wherein the partially polymerized methylol phosphorus material is a product of the reaction of tetrakis(hydroxymethyl)phosphonium sulfate or chloride with urea.

* * * * *